US011525636B2

(12) United States Patent
Holman et al.

(10) Patent No.: US 11,525,636 B2
(45) Date of Patent: Dec. 13, 2022

(54) METHOD AND SYSTEM FOR STABILIZING LOOP HEAT PIPE OPERATION WITH A CONTROLLABLE CONDENSER BYPASS

(71) Applicant: The Government of the United States of America, as represented by the Secretary of the Navy, Arlington, VA (US)

(72) Inventors: Timothy Holman, Alexandria, VA (US); Dmitry K Khrustalev, Woodstock, MD (US); Kwok Cheung, Ashburn, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 251 days.

(21) Appl. No.: 16/826,087

(22) Filed: Mar. 20, 2020

(65) Prior Publication Data

US 2020/0300555 A1 Sep. 24, 2020

Related U.S. Application Data

(60) Provisional application No. 62/821,162, filed on Mar. 20, 2019.

(51) Int. Cl.

| | |
|---|---|
| ***F28D 15/06*** | (2006.01) |
| ***F28D 15/04*** | (2006.01) |
| ***F28D 15/02*** | (2006.01) |

(52) U.S. Cl.
CPC ..... *F28D 15/06* (2013.01); *F28D 15/0266* (2013.01); *F28D 15/043* (2013.01)

(58) Field of Classification Search
CPC .... F28D 15/06; F28D 15/0266; F28D 15/043; F25B 2321/02; F25B 2321/025; F25B 21/02
See application file for complete search history.

(56) References Cited

U.S. PATENT DOCUMENTS 3,776,304 A * 12/1973 Auerbach ..... F28D 15/06 136/203
4,026,348 A * 5/1977 Roberts, Jr. ..... F28D 15/06 165/274
4,515,209 A * 5/1985 Maidanik ..... F28D 15/043 417/208

(Continued)

*Primary Examiner* — Travis Ruby
(74) *Attorney, Agent, or Firm* — US Naval Research Laboratory; Suresh Koshy

(57) ABSTRACT

A loop heat pipe includes a reservoir, an evaporator adjacent to the reservoir, and a condenser including a condenser inlet and a condenser outlet. The loop heat pipe further includes a vapor transport line connecting the evaporator to the condenser inlet, a liquid transport line connecting the condenser outlet to the evaporator, and a vapor bypass joining the vapor transport line near the condenser inlet and joining the liquid transport line near the condenser outlet. The vapor bypass includes a vapor bypass housing. The vapor bypass housing includes a temperature. The loop heat pipe also includes a thermally-controlled connection between the vapor bypass housing and the condenser, and a thermal controller connected to the thermally-controlled connection and regulating the temperature of the vapor bypass housing via the thermally-controlled connection.

7 Claims, 3 Drawing Sheets

(56) References Cited

U.S. PATENT DOCUMENTS

| | | | | |
|---|---|---|---|---|
| 5,587,880 | A * | 12/1996 | Phillips | F28F 3/12 361/679.53 |
| 6,971,442 | B2 * | 12/2005 | Sauciuc | F28D 15/0266 257/714 |
| 8,752,616 | B2 * | 6/2014 | Kroliczek | F28D 15/043 165/274 |
| 10,182,517 | B2 * | 1/2019 | Yoshikawa | F28D 15/0266 |
| 2005/0024831 | A1 * | 2/2005 | Phillips | H05K 7/20809 361/700 |
| 2007/0209782 | A1 * | 9/2007 | Wyatt | H05K 7/20827 165/104.31 |
| 2009/0077981 | A1 * | 3/2009 | Wyatt | F25B 23/006 62/3.7 |
| 2009/0126905 | A1 * | 5/2009 | Dinh | F21K 9/00 165/104.33 |
| 2009/0284926 | A1 * | 11/2009 | Agostini | F28D 15/0266 165/104.21 |
| 2012/0000630 | A1 * | 1/2012 | Reiss | H05K 7/20354 165/104.11 |
| 2012/0024497 | A1 * | 2/2012 | Kroliczek | F28D 15/046 165/104.13 |
| 2012/0198859 | A1 * | 8/2012 | Sepulveda | F28D 15/0275 62/3.1 |
| 2013/0306278 | A1 * | 11/2013 | Hoang | F28D 15/043 165/104.26 |
| 2017/0363365 | A1 * | 12/2017 | Aoki | F28D 15/02 |
| 2018/0031329 | A1 * | 2/2018 | Wang | G06F 1/203 |
| 2018/0231327 | A1 * | 8/2018 | Cho | F28D 15/04 |
| 2018/0340739 | A1 * | 11/2018 | Hoang | F28D 15/043 |
| 2020/0208886 | A1 * | 7/2020 | Adelmann | F24H 1/185 |
| 2021/0396477 | A1 * | 12/2021 | Khrustalev | F28D 15/0266 |

* cited by examiner

METHOD AND SYSTEM FOR STABILIZING LOOP HEAT PIPE OPERATION WITH A CONTROLLABLE CONDENSER BYPASS

RELATED APPLICATIONS

This application claims the benefit of U.S. Provisional Application No. 62/821,162 filed Mar. 20, 2019, which is hereby incorporated herein by reference.

FEDERALLY-SPONSORED RESEARCH AND DEVELOPMENT

The United States Government has ownership rights in this invention. Licensing inquiries may be directed to Office of Technology Transfer, U.S. Naval Research Laboratory, Code 1004, Washington, D.C. 20375, USA; +1.202.767.7230; techtran@nrl.navy.mil, referencing NC 106641.

FIELD OF INVENTION

The present invention relates generally to Loop Heat Pipes (LHP), and more particularly to stabilizing loop heat pipe operation.

BACKGROUND

Loop heat pipe operation can exhibit some undesirable instabilities manifested as thermal-fluid oscillations (TFOs) and even partial dryouts resulting from quick fluid dynamics effects or TFOs. Temperature Oscillations are usually undesirable for high-power temperature-sensitive electronics used in space programs, which are cooled by LHP-based radiators. Moreover, TFOs are associated with variations of the liquid temperature and flow rate in the liquid return line. Such large-amplitude variations due to TFOs or similar thermal fluid transients can potentially result in the partial dryouts of the LHP evaporator, which might be seen as unacceptable by the LHP users and therefore filler restricting LHP applications, especially for high power levels in excess of one kilowatt.

There are only two conventional methods directly intended to stabilize LHP operation in terms of eliminating thermal-fluid oscillations;

1. Heating the LHP Reservoir by using an electrical heater to keep the Reservoir temperature above a predetermined temperature, 2. Installing a three-way mechanical valve on the vapor transport line in the vicinity of the evaporator to send some vapor to the LHP Reservoir through an additional bypass line thus delivering some thermal energy to the Reservoir, with the vapor flow, to keep it above some temperature level where thermal-fluid oscillations can develop.

Additionally, utilizing thermal straps between the vapor and liquid transport lines have been used (to elevate temperature of the liquid flowing to reservoir) with the objective to reduce the electrical power expenditure for the Reservoir control heater.

SUMMARY OF INVENTION

Disadvantages of the known background methods are:

(a) Heating the Reservoir consumes electrical power (up to 20%), which is at premium in most of space applications. Additionally a complex customized control algorithm needs to be developed, programmed, and tested on the ground prior to the space mission in order to control operation of the reservoir heater in orbit, where actual environmental conditions can be different from those mimicked during the ground testing.

(b) Three-way (or two-way) mechanical valves contain moving parts, such as bellows and the valve internal passages are periodically under high-pressure contact with mechanical parts closing such passages. Time life of such valves is limited due to the tear and wear of moving parts and surfaces. Moreover such valves respond very slowly to the temperature of a LHP component where the sensor is located. The temperature-actuated fluid flow regulation by the valve is therefore lagging behind the much faster (dynamic fluid transient, which can be causing unintended temperature fluctuations (due to the time delay and overshoots) produced by the valve itself.

(c) Thermal straps between the vapor and liquid transport lines are very ineffective in terms of the thermal energy transport. A typical reason for being ineffective is a very low heat transfer coefficient between the vapor flow and the wall of the vapor transport line. Also thermal straps themselves have low effective thermal conductivity and add mass/vibration problems to the system.

Therefore, presented is a system and method of stabilizing operation of loop heat pipes by adding a controllable small-inner-diameter tubing bypassing LHP condenser. Such condenser bypass stabilizes LHP thermal operation, which otherwise can exhibit undesirable thermal-fluid oscillations under some conditions, especially with a mass attached to LHP evaporator (payload). Controllability of such condenser bypass stabilizing function, positioned in close proximity to the cold LHP condenser plate, can be achieved by applying a very low auxiliary power (heating or cooling) to the bypass tubing and/or to the liquid return line, without utilizing any moving parts in the LHP system. Moreover, such system with a small gas-loaded heat pipe used as a thermal strap to cool the condenser bypass housing can potentially operate in a completely autonomous manner.

According to one aspect of the invention, a method of stabilizing a loop heat pipe (LHP) operation includes arranging a portion of vapor flow at a condenser inlet to bypass a condenser; arranging the portion to freely and continuously flow into a liquid return line at an outlet of the condenser; and additionally warming liquid inside the liquid return line by utilizing a heater.

Optionally, the method includes the portion of the vapor flow at the condenser inlet bypassing only a portion of the condenser length; and the portion of the vapor flow flowing into the remaining portion of the condenser upstream of condensed fluid flow exiting from the condenser into the liquid return line at the condenser outlet. The vapor flow in the bypass tubing additionally elevates temperature of the condensed fluid at the condenser outlet.

Optionally, the method includes the portion of the vapor flowing from a middle of the condenser bypassing an upstream portion of the condenser length; and the portion of the vapor flowing into the liquid return line at the condenser outlet where the vapor flow in the bypass tubing additionally elevates temperature of the condensed fluid at the condenser outlet.

Optionally, the method includes adjusting the vapor flow of the condenser bypass, thereby altering fluid flow quality and mass flow rate in the bypass tubing, by heating or cooling the vapor bypass housing with a heater or cooler, respectively.

Optionally, the method includes using a gas-loaded heat pipe as a variable conductance thermal strap to cool bypass housing progressively and in an autonomous manner when condenser plate temperature is elevated.

Optionally, the method includes using electrical heaters used on a liquid return line as an alternative or a supplemental means of stabilizing LHP operation.

According to another aspect of the invention, a stabilized loop heat pipe (LHP) includes a two-phase loop heat pipe capillary evaporator; a condenser; a vapor bypass joining a vapor transport line near an inlet of the condenser with a liquid transport line at an outlet of the condenser; a thermally-controlled thermal connection of vapor bypass housing to the condenser for cold biasing; and a thermal controller regulating a temperature of the bypass housing.

Optionally, the vapor bypass comprises a small diameter tubing having an inlet at the vapor transport line near the condenser and an outlet at the liquid return line near the condenser outlet.

Optionally, the vapor bypass comprises a small diameter tubing having an inlet at the vapor transport line near the condenser and an outlet at a middle of the condenser.

Optionally the vapor bypass comprises a small diameter tubing having an inlet in a middle of the condenser and an outlet at the liquid return line near the condenser outlet.

Optionally, the vapor bypass comprises a small diameter tubing, which is completely or partially protected from environmental effects by thermal insulation.

Optionally, the vapor bypass comprises a small diameter tubing, which is completely or partially exposed to environmental effects through thermal radiation from its extended outer surface.

Optionally, the stabilized LHP includes thermal straps between the bypass housing and the condenser plate to cold-bias the bypass housing, thereby partially condensing vapor inside the bypass tubing.

Optionally, the stabilized LHP includes thermal straps between the bypass housing and the condenser plate to cold-bias the bypass housing, thereby partially condensing vapor inside the bypass tubing; and electrical heaters installed on the thermal straps adjacent to the bypass tubing, thereby preventing condensation inside the bypass tubing and/or superheating the vapor flow inside the bypass tubing.

Optionally, the stabilized LHP includes thermal straps between the bypass housing and the condenser plate to cold-bias the bypass housing, thereby partially condensing vapor inside the bypass tubing; and thermal electric coolers (TEC) installed on the thermal straps adjacent to the bypass tubing, thereby achieving condensation of the vapor inside the bypass tubing, eliminating the warming effect of the bypass on the liquid returning to the reservoir, and/or additionally cooling the liquid flowing to the reservoir to compensate for the environmental heating or to condense the vapor fraction in the liquid flow.

Optionally, the stabilized LHP includes electrical heaters installed on the liquid return line to complement warming of the liquid flow to reservoir through the condenser bypass tubing and to fine-tune the stabilizing effed on the LHP operation.

Optionally, the stabilized LHP includes thermal electrical coolers installed on the liquid return line to provide cooling of the liquid flow to reservoir in order to compensate for the environmental heating of the liquid transport line and reservoir.

Optionally, the stabilized LHP includes a gas-loaded heat pipe, with one end in thermal contact with the condenser plate and another end in thermal contact with the bypass housing, thereby used as a variable conductance thermal strap to cool the bypass housing progressively and in an autonomous manner as the condenser plate temperature is increasing.

Optionally, the stabilized LHP includes a small electrical heater placed on a body of the heat pipe and configured to be on when the condenser plate temperature is low, thereby disrupting the heat pipe operation and warming the vapor flow inside the bypass line.

Optionally, the bypass tubing is corrugated, thereby increasing its dynamic flow resistance specifically at high power levels.

Optionally, the LHP uses a pulsating heat pipe as a temperature-dependent thermal strap.

The foregoing and other features of the invention are hereinafter described in greater detail with reference to the accompanying drawings.

DETAILED DESCRIPTION

This invented method to stabilize a Loop Heat Pipe operation and to eliminate or at least significantly reduce instabilities such as thermal-fluid oscillations, partial evaporator dryouts, quick fluid dynamics events, etc., includes a controllable fluid path with a small-inner-diameter in the vicinity of the LHP condenser and bypassing the LHP condenser, which allows a fraction of the vapor flow in the LHP vapor transport line to flow directly into the liquid return line. The housing of the bypass path extending between the inlet at the vapor line and the outlet at the liquid transport line can be cooled or heated in a controllable manner in order to achieve appropriate warming of the liquid flowing in the liquid return line by releasing the latent heat of vaporization into the liquid return flow, where part of the warming effect can be supplemented by the heaters or thermal electric coolers on the liquid transport line, with overall objective to prevent, control or eliminate various operational thermal-fluid instabilities in the LHP.

An aspect of the invention is directed to a two-phase heat transfer system, such as a Loop Heat Pipe, comprising: at least one two-phase loop heat pipe capillary evaporator; at least one condenser; a vapor bypass joining the vapor transport line near the inlet of the condenser with the liquid transport line at the outlet of the condenser; and a thermally-controlled thermal connection, for example thermal straps, of such bypass housing to the condenser plate for cold biasing, as well as heaters or thermal electric coolers to regulate the bypass housing temperature and the liquid return line housing temperature.

Figure 1:
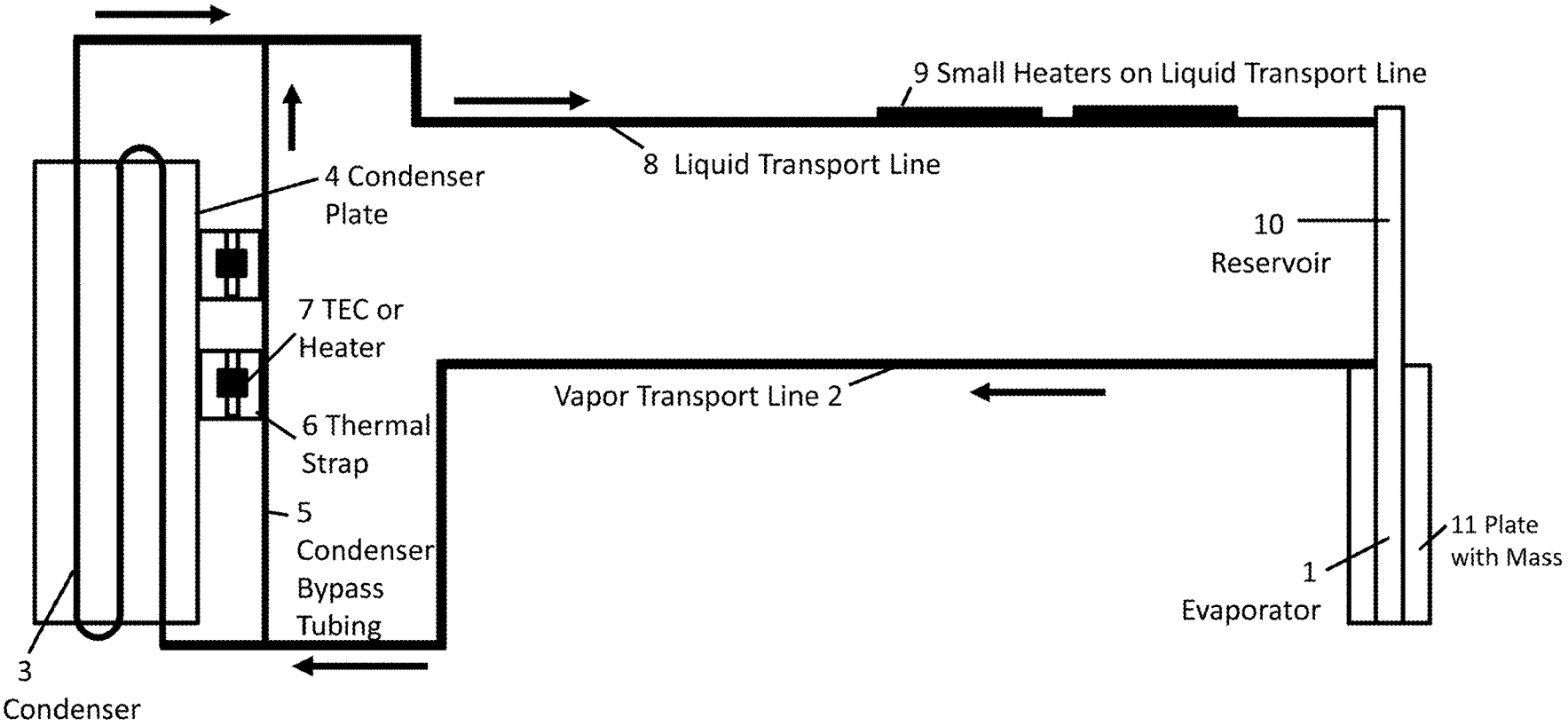
FIG. 1 shows a schematic of an exemplary loop heat pipe with a full bypass of the condenser.

External heating of a LHP evaporator 1, shown in FIG. 1, evaporates working fluid (liquid) inside the evaporator primary porous wick. Capillary pressure, developed by the primary wick, pushes the vapor flow into the vapor transport line 2 and further into condenser 3, which is attached to the condenser plate 4 cooled externally by a heat sink. Vapor is normally fully condensed inside condenser 3 and cold liquid coming out of the condenser 3 into the liquid return line 8 is usually colder than the saturation temperature of the reservoir 10. Liquid entering the reservoir 10 through the liquid transport line 8 cools the reservoir to some extent, compensating for the reservoir heating due to the internal heat leak from the evaporator 1 to the reservoir 10, which allows the reservoir to reach a steady state operational temperature. Additionally, excessively cold liquid entering the LHP reservoir might cause thermal fluid oscillations, destabilizing the LHP operation.

Exemplary embodiments for stabilizing LHP operation utilize several additional small and simple components (without moving parts) added to the basic LHP schematic;

a) Condenser bypass small diameter tubing 5, which potentially allows~2% of the vapor flow to bypass the condenser, b) Thermal Straps 6 between the condenser bypass tubing 5 and the cold condenser plate 4, providing some low-level cooling of the bypass tubing 5, c) Thermal Electric Coolers 7 integrated with the thermal straps, which can provide either heating or cooling, when turned on, to the bypass tubing by switching the polarity (or single electrical heaters instead of TECs), d) Small heaters 9 on the liquid return line to increase temperature of the cold liquid flowing to the reservoir (for the system fine-tuning and/or for redundancy purposes).

Functions and thermal-fluid operation of these added components are explained below in more detail.

The Condenser Bypass 5, shown in FIG. 1, can be adiabatic (covered with a thermal insulation) and can operate without any thermal straps or TEC, still preventing TFOs for a wide range of the heat loads on the LHP evaporator, provided it is sized correctly for that power range and environmental conditions. The Condenser Bypass 5 allows a small fraction (~2%) of the vapor flow in the vapor transport line to bypass the condenser, due to the existing pressure drop across the condenser at a particular operational time. It is important to note that vapor flow rate through the bypass instantly increases proportionally to the pressure drop across the condenser exactly at the moment when there is a cold liquid surge coming out of the condenser. It can be stated therefore that the bypass vapor flow rate is synchronized with and proportional to the condenser fluid mass flow rate. The bypass vapor mass flow rate of $m_v$ enters the liquid return line where the liquid flow rate is $m_L$ and elevates temperature of the cold liquid coming out of the condenser by condensing in the cold liquid and releasing its latent heat of vaporization so that the cold liquid temperature would increase by ΔT, which value is approximated for steady flow conditions as $$\Delta T=(m_v\, h_{fg})/(m_L\, c_{pL}) \quad (1)$$

Warming the cold liquid returning to the condenser during a potential cold liquid surge reduces or completely eliminates TFOs by stabilizing the reservoir temperature (essentially preventing its temperature variations in time).

Predictions generated by a numerical model but without any condenser bypass (or heaters) show significant temperature oscillations exhibited on the reservoir and liquid return line. Such TFOs were in fact observed during LHP testing, as well.

If the condenser bypass tubing is being cooled by TECs, or due to heat losses either to the environment or to the cold condenser plate, the vapor inside the capillary tubing bypass would be partially or fully condensed, depending on the level of such heat losses, with mainly liquid flowing through the condenser bypass. If there is no vapor flowing through the bypass tubing into the liquid return line, than the liquid return flow warming due to the latent heat of vaporization expressed by equation (1) does not exist and the LHP can experience TFOs, almost as if there is no condenser bypass. Numerical predictions for the case where the 1.5 mm ID bypass is cooled by the condenser plate (with the effective heat transfer coefficient of 310 W/mA-K on the entire outer surface of the bypass tubing) were also made. TFOs in this simulation developed from a complete initial steady state and are only slightly different from the case without any bypass mentioned above. Therefore a low-level cooling of the condenser bypass provides some control over the vapor flow in it and hence over its stabilizing function, without using any moving parts.

Summarizing, the invented method includes adding a controllable small inner diameter tubing bypassing LHP condenser. Such condenser bypass stabilizes LHP operation, which otherwise can exhibit undesirable thermal-fluid oscillations under some conditions, especially with a mass attached to LHP evaporator (payload). Controllability of such condenser bypass function, positioned in close proximity to the cold LHP condenser plate, can be achieved by applying a very low auxiliary power (heating or cooling) to the bypass tubing, without utilizing any moving parts in the LHP system.

Another part of exemplary LHP stabilization methods are electrical heaters or TECs 9 installed on the LHP liquid return line shown in FIG. 1. Such heaters or TECs can be used as an additional means to stabilize the LHP operation, separately from or jointly with the already existing condenser bypass, expanding range of the LHP operational parameters, such as the condenser sink temperature. In other words, the liquid return line heaters (or TECs) may be included into exemplary LHP stabilization system for fine-tuning, LHP enhanced adjustability, and redundancy of the stabilizing system. Moreover, such heaters on the liquid return line can serve an important role by themselves in terms of eliminating LHP TFOs (thus stabilizing the LHP operation), as explained below.

Experiments have been conducted on the LHP presented above with only liquid line heaters (without any condenser bypass). Test data provides clear evidence that elevating the heat load level on the liquid line heaters to 9 W (3% of 300 W) completely eliminated TFOs observed on the LHP heat loaded at 300 W (without the attached mass) prior to the test time of 874,000 seconds. Additional test data for the power level of 175 W indicates that only 2 W (1.2% of 175 W) of the liquid transport line heating was sufficient to eliminate thermal-fluid oscillations. Turning off the liquid line heating was followed by re-appearance of the thermal fluid oscillations.

Such methods of heating the liquid return line to suppress TFOs (and generally to stabilize the LHP operation) may be more effective than applying heat load to the LHP Reservoir. The method can be simplified to keeping the liquid return line heaters at about 2% or 3% of the evaporator electrical heat load level at all times, when instabilities are anticipated.

For comparison, reservoir heating stabilizing approach to eliminate TFOs by utilizing heating of the reservoir to prevent its temperature from dropping below a certain level has been demonstrated. Such demonstration was only successful with a proportional-control approach (much more difficult to implement than a continuous heating), where the time-averaged control power consumption was about 2 W (for the 75 W heat load case). Subsequent attempts to continuously apply 2 W to the LHP reservoir (2.7% of 75 W) did not succeed in that the operating LHP temperature started to increase rather significantly, which is undesirable.

This indicates that the reservoir heating method is less preferable than the liquid return line heating.

Figure 2:
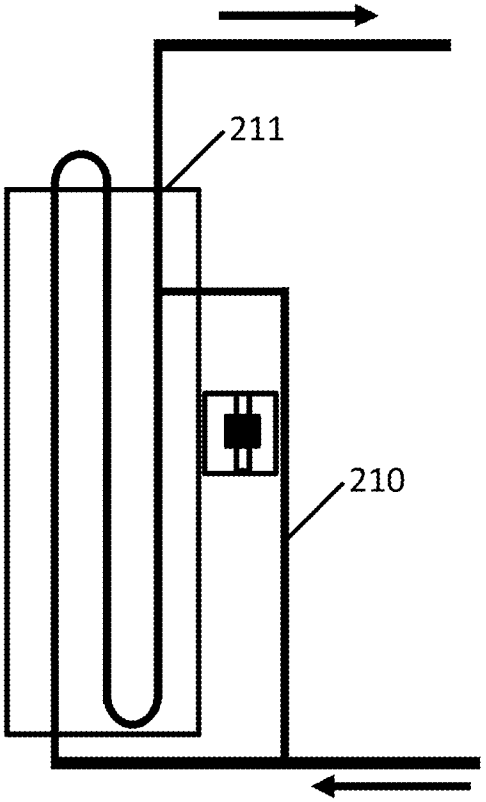
FIG. 2 shows another schematic of an exemplary loop heat pipe with a partial bypass of the condenser.

Referring now to FIG. 2, shown is another exemplary embodiment LHP 200, with a partial bypass 210. In this case, the bypass only bypasses the upstream portion of the condenser by entering the condenser upstream from the condenser outlet 211.

Figure 3:
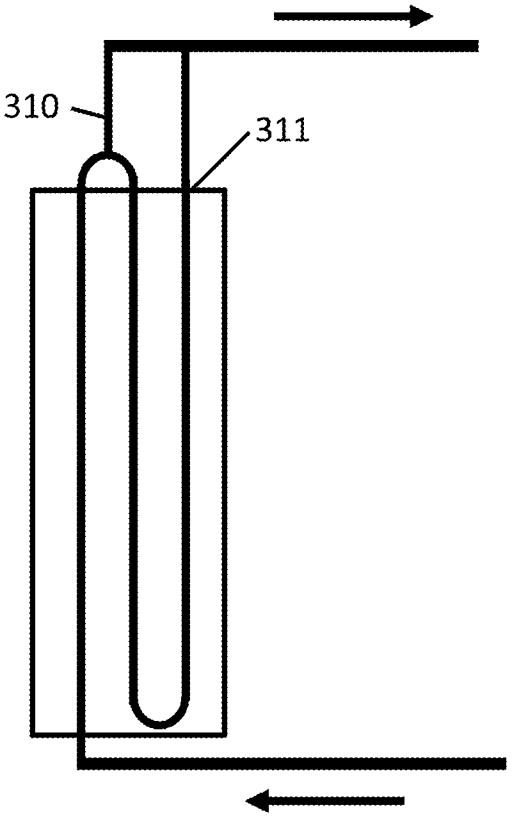
FIG. 3 shows another schematic of an exemplary loop heat pipe with a partial bypass of the condenser.

Referring now to FIG. 3, shown is another exemplary embodiment LHP 300, with a partial bypass 310. In this case, the bypass only bypasses the downstream portion of the condenser by exiting the condenser upstream from the condenser outlet 211.

Figure 4:
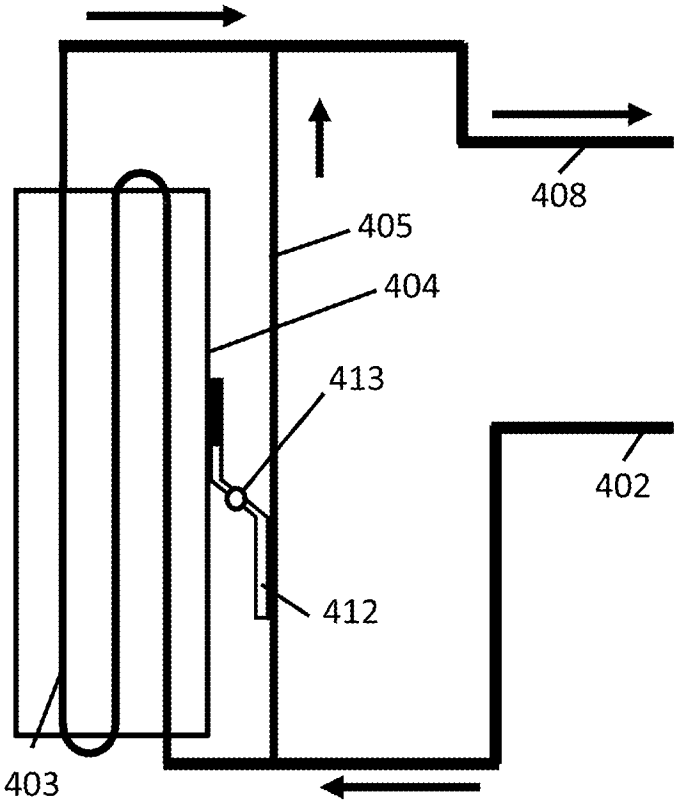
FIG. 4 shows another schematic of an exemplary loop heat pipe with a gas-loaded heat pipe used as a thermal strap.

Referring now to FIG. 4, a gas-loaded heat pipe 412 can be used as a variable conductance thermal strap between the bypass tubing and the condenser plate so that such system can operate in a fully autonomous manner and without using any heaters or TECs. Such autonomous operation is possible due to compression of the non-condensable gas (due to increased saturation pressure of the working fluid) inside the gas-loaded heat pipe when the condenser plate temperature is elevated, at which time the heat pipe starts to progressively cool the bypass tubing more effectively and thus partially or fully preventing the vapor flow through the bypass.

Additionally, a small electrical heater 413 can be installed on the heat pipe body 412. Turning on heater 413 can disrupt the heat pipe operation and keep the warm vapor flowing inside the bypass line when appropriate.

One advantage of the exemplary methods (versus heating the LHP reservoir) is that it intends to prevent or at least reduce surges of the cold liquid into the LHP reservoir in an intrinsically synchronized manner, where the vapor flow in the bypass is synchronized with the pressure drop across the condenser and is proportional to the surges of the cold liquid out of the condenser. Heating the reservoir with an electrical heater can be only synchronized with the already developing variation of the reservoir temperature, which is already lagging behind the liquid flow rate variation. Therefore, the invented method is much faster and effective (versus the reservoir heating) in terms of stabilizing a LHP operation at very early stages of cold liquid surges in development.

A second advantage of exemplary methods (versus heating the LHP reservoir) is that it significantly reduces the control power consumption by simply utilizing the latent heat of vaporization of the bypass vapor flow to warm the cold liquid returning to the reservoir to a needed extent.

A third advantage of exemplary methods are that they allow adjustment of operation of the already-manufactured expensive LHP to changes in the requirements by simply altering or replacing the inexpensive thermal straps between the condenser plate and bypass tubing. In other words the additional benefit is that the condenser bypass function can be adjusted after the expensive LHP system is manufactured and delivered to the user as needed due to mission changes (heat load levels re-defined, orbital environments changed, etc.). Depending on the situation, the low-conductance thermal straps can be added, removed, or replaced rather readily as they are external add-on components and do not effect sensitive internal components of the expensive Loop Heat Pipe system itself during such addition or removal (as soon as the bypass was pre-installed during the LHP fabrication).

A fourth advantage of exemplary methods, versus using a mechanical valve with moving internal parts, is that there are not any moving parts involved in the condenser bypass method, which is highly beneficial and desirable for the reliability of LHP operation, especially for long-term deep space missions.

A fifth advantage of the invented method with a gas-loaded heat pipe used as a variable conductance thermal strap between the bypass tubing and the condenser plate is that such system can operate in a fully autonomous manner and without using any heaters or TECs. Such autonomous operation is possible due to expansion of the non-condensable gas inside the gas-loaded heat pipe when the condenser plate temperature is elevated, at which time the heat pipe starts to cool the bypass tubing effectively and thus prevents the vapor flow through the bypass.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A loop heat pipe (LHP) comprising:

a reservoir;

an evaporator adjacent to the reservoir;

a condenser comprising a condenser inlet and a condenser outlet;

a vapor transport line connecting the evaporator to the condenser inlet;

a liquid transport line connecting the condenser outlet to the evaporator;

a vapor bypass joining the vapor transport line near the condenser inlet and joining the liquid transport line near the condenser outlet, the vapor bypass comprising a vapor bypass housing, the vapor bypass housing comprising a temperature;

a thermally-controlled connection between the vapor bypass housing and the condenser; and a thermal controller connected to the thermally-controlled connection and regulating the temperature of the vapor bypass housing via the thermally-controlled connection.

2. The LHP of claim 1, wherein the vapor bypass comprises a tubing comprising a vapor bypass inlet at the vapor transport line near the condenser inlet and comprising a vapor bypass outlet at the liquid return line near the condenser outlet, the tubing comprising a tubing diameter, the vapor transport line comprising a vapor transport line diameter, the tubing diameter being smaller than the vapor transport line diameter.

3. The LHP of claim 2, wherein the vapor bypass tubing, comprises thermal insulation.

4. The LHP of claim 1, wherein the thermally-controlled connection comprises thermal straps.

5. The LHP of claim 1, wherein the thermal controller comprises at least one of:

a heater; and a thermal electrical cooler.

6. The LHP of claim 1, wherein the vapor bypass tubing comprises corrugated tubing.

7. The LHP of claim 1, further comprising:

a least one heater connected to the liquid transport line.

* * * * *